US005837663A

United States Patent [19]

Nicholson et al.

[11] Patent Number: 5,837,663

[45] Date of Patent: Nov. 17, 1998

[54] MACHINE DISHWASHING TABLETS CONTAINING A PERACID

[75] Inventors: John Richard Nicholson, Ramsey; Bozena Marianna Piatek, Cedar Grove, both of N.J.; David John Lang, Ossining, N.Y.; Isaac Israel Secemski, Teaneck, N.J.

[73] Assignee: Lever Brothers Company, Division of Conopco, Inc., New York, N.Y.

[21] Appl. No.: 780,062

[22] Filed: Dec. 23, 1996

[51] Int. Cl.[6] ..... C11D 17/00; C11D 3/395

[52] U.S. Cl. ..... 510/226; 510/224

[58] Field of Search ..... 510/224, 226

[56] References Cited

U.S. PATENT DOCUMENTS

| | | | |
|---|---|---|---|
| 4,219,435 | 8/1980 | Biard et al. | 510/224 |
| 4,828,745 | 5/1989 | Jeschke et al. | 510/224 |
| 4,828,749 | 5/1989 | Kruse et al. | 510/224 |
| 4,839,078 | 6/1989 | Kruse et al. | 510/224 |
| 4,897,212 | 1/1990 | Kruse et al. | 510/224 |
| 4,913,832 | 4/1990 | Kruse et al. | 252/99 |
| 4,988,363 | 1/1991 | Barnes | 8/111 |
| 5,133,892 | 7/1992 | Chun et al. | 510/224 |
| 5,358,655 | 10/1994 | Kruse et al. | 252/95 |
| 5,453,216 | 9/1995 | Kellett | 510/220 |
| 5,527,484 | 6/1996 | Ahmed et al. | 510/226 |
| 5,705,465 | 1/1998 | Angevaare et al. | 510/220 |
| 5,710,115 | 1/1998 | Patel et al. | 510/226 |

FOREIGN PATENT DOCUMENTS

| | | |
|---|---|---|
| 264 071 | 4/1988 | European Pat. Off. . |
| 4229650 | 1/1994 | Germany . |
| 91/15568 | 10/1991 | WIPO . |
| 93/00419 | 1/1993 | WIPO . |

*Primary Examiner*—Ellen M. McAvoy
*Attorney, Agent, or Firm*—A. Kate Huffman

[57] ABSTRACT

A solid detergent composition useful for machine dishwashing is described. The product contains a first layer having a buffering system, a builder and an enzyme. The first layer dissolves to deliver a pH of about 9.0 to about 11 in the wash water. A second layer includes a peracid and an acidity agent in a continuous medium having a melting point in the range of from about 35° C. to about 50° C. The material may be a paraffin wax, a natural wax, a polyvinyl ether, fatty acids and mixtures thereof. The second layer dissolves in wash water to deliver a pH of from about 6.5 to about 9. The release order of the functional ingredients allows for a optimum bleaching of stains as well as removal of soil.

19 Claims, No Drawings

MACHINE DISHWASHING TABLETS CONTAINING A PERACID

FIELD OF THE INVENTION

The invention relates to machine dishwashing detergent compositions in solid tablet form having a first layer containing a buffering system, enzymes, builder and a second layer containing a peracid source and an acidity agent in a continuous medium to optimize the functionality of the active ingredients and provide excellent overall cleaning performance.

BACKGROUND OF THE INVENTION

The share of machine dishwashing tablets in certain markets has grown significantly in recent years primarily because they are perceived to be more convenient than alternative product forms such as powders. However, the product form and method of delivery of tablets can limit both the type of functional ingredients incorporated and the level of functionality from these ingredients.

A complication unique to tablets derives from the method of introduction into the machine. Thus, some tablets are designed to be placed directly into the machine itself, such as in a basket hanging from the upper rack, where they come into contact with a water spray as soon as the machine starts, while others are delivered via the dispenser and are only released during the main wash cycle. Clearly, the release and performance of functional ingredients will differ depending on how the tablet is delivered.

Each type of delivery has potential weaknesses. Thus, for tablets that come into immediate contact with the water spray, some of the functional ingredients can be released into the pre-wash where, if the temperature is too low the ingredients will be lost without delivering a significant benefit. For both types of tablets, complete dissolution may not occur during the main wash cycle. If part of the tablet is still available for dissolution in the rinse, serious spotting and filming problems can occur. These potential negatives are specific to the tablet form. Liquids or powders are introduced into the wash via the dispensing cup and so there are no losses during the pre-wash and the rapid rate of dissolution of these products ensures no carry over of undissolved product into the rinse. Current tablet technology is not consistently successful in meeting the performance standards of other product forms by ensuring that all the functional ingredients are delivered during the appropriate part of wash cycle.

This invention specifically relates to tablet compositions containing a peracid. It is known that peracids function as bleaches in wash solutions most effectively around their pKa, which typically lies between pH 7 and 9, whereas proteases for detergents function optimally at a higher pH range, that is between 9 and 10. Because of these mutually incompatible wash conditions, it has previously been difficult to deliver both optimum bleaching from a peracid and optimum soil removal from a protease from a single product. This invention teaches a novel route to deliver excellent overall performance from a composition containing both a peracid and a protease.

Prior art attempts to optimize the performance of tablet technology have primarily been directed towards modification of the dissolution profile of tablets. This is deemed especially important for those tablets that are placed in the machine such that they come into contact with a water spray at the very beginning of the wash process. A number of patents suggest technology to minimize dissolution in the pre-wash to allow the maximum amount of functional ingredients to operate in the main wash. In particular, a 2-layer tablet for machine dishwashing is described in EP 224128. Both layers contain metasilicate and triphosphate but by modifying the degree of hydration one layer is cold water soluble while the other layer dissolves rapidly at increasing temperatures.

Similarly, EP 224135 describes a combination of a cold water-soluble melt or tablet with a cold water-resistant melt or tablet that is soluble at increasing water temperatures. The cold water-soluble melt composition consists of a mixture of metasilicate monohydrate, pentahydrate and anhydrous metasilicate and the cold water-resistant tablet layer consists of metasilicate nonahydrate and triphosphate. EP 224136 describes similar compositions in the form of multi-layer fused blocks in which the layers have different dissolution rates. One layer consists of metasilicates having different degrees of hydration and another layer consists predominantly of sodium metasilicates and anhydrous sodium tripolyphosphate.

Phosphate-free tablets containing a combination of metasilicates, a low foaming surfactant, sodium acrylate, sodium carbonate, sodium sulfate, a bleaching agent and water are described in WO 9115568. These tablets are claimed to be 10–40% soluble in the cold water pre-rinse leaving 60–90% for the main wash.

WO 9300419 describes production of phosphate- and metasilicate-free tablets. Anhydrous sodium carbonate and optionally other builders are mixed with acrylate and water sufficient for partial hydration of the anhydrous carbonate. The remaining components are added and the whole compressed into a tablet. The advantage is that the tablets only partially dissolve during the pre-wash stage so that greater than 50% is available for the main wash. Similar technology is described in DE 4112075.

A broad solubility profile for tablets is described in EP 264701. The tablets contain preferred ratios of anhydrous and hydrated metasilicates and anhydrous triphosphate, active chlorine compounds and a tabletting aid consisting of a mixture of sodium acetate and spray-dried sodium zeolite. Good solubility in warm water makes at least 65% of the tablet available for the cleaning stage of the wash.

DE 4229650 describes a tablet with rapid dissolution. Anhydrous sodium tripolyphosphate is partially hydrated to tripolyphosphate hexahydrate and the partial hydrate is mixed with powdered water-free silicate, sprayed with water or aqueous silicate, granulated and mixed with optional cleaning components. Tabletting auxiliaries sodium metasilicate pentahydrate and/or nanohydrate comprising of about 8–12% of the total granulate mix are included.

Thus, in terms of optimizing the performance of machine dishwashing tablets, the prior art primarily deals with traditional high pH formulations systems and suggested routes to improving the performance of tablets rely on modifying solubility profiles in a fairly coarse manner.

Regarding peracids specifically, EP 290081 describes reducing the pH of the wash liquid during washing of fabrics to allow the peracid to function optimally. The publication thus describes that a peracid functions optimally around its pKa but does not describe a means of obtaining this result at the appropriate time during a machine dishwashing cycle.

Thus, one object of the present invention is to utilize the unique characteristics of the tablet form to effectively deliver the functional ingredients, especially the peracid and enzymes, at the appropriate time during the wash cycle.

Another object of the invention is to minimize loss of bleach in prewashes using tablets that are dosed directly into the automatic dishwashing machine.

In addition, the present invention minimizes the interaction in the wash solution between bleaching agent and enzymes, two mutually incompatible ingredients, by allowing the enzyme to function in the wash first, followed by the peracid.

The technology of the present invention provides tablets which are both more aesthetically pleasing and more consumer friendly than conventional tablets by virtue of the virtual absence of fines on the inventive tablet surface.

SUMMARY OF THE INVENTION

The present invention relates to solid product forms for use in machine dishwashing and warewashing applications that have good handling characteristics and excellent cleaning performance by virtue of optimizing the functionality of a peracid via controlled release of ingredients. The product is preferably in the form of tablets having at least two layers.

The first layer of a two layer tablet includes from about 5 wt. % to about 90 wt. % of a builder, one or more enzymes and a buffering system. Optionally, a surfactant, a processing aid to allow a high strength tablet to be processed under relatively low compaction pressures, a disintegrant to aid in tablet dissolution and a lubricant to aid processing are present.

A second layer of a two-layer tablet includes a peracid and a source of acidity in a continuous medium that has a minimum melting point of about 35° C. and a maximum melting point of about 50° C. The peracid may be incorporated into the continuous medium in a number of ways, but preferably the peracid is initially granulated in combination with an exotherm control agent as well as a surfactant to enhance dissolution. A source of acidity can be added separately, either as is or as granulates or can be included within the peracid granule.

The selection of buffer in the first layer of the tablet is such that when this layer dissolves, the wash pH lies between about 9.0 and about 11.0 and the level of acidity agent should be such that, after the second layer is released, the wash pH is between about 6.5 and about 9.0.

The separate layers provide an order of release which allows for both maximum soil removal and bleaching for overall excellent performance. In contrast, prior art systems deliver all ingredients in a high pH range, where the functionality of the peracid will not be optimal, or at low pH, where soil removal will be relatively poor.

In addition, in the tablets of the current invention there is minimal dissolution of oxygen bleach into the prewash. This is important since oxygen bleaches deliver very little benefit in the low wash temperatures of a prewash cycle. Thus, any premature release of oxygen bleach in the prewash will reduce the amount of bleach available to the main wash where the conditions are much more favorable for bleaching action.

The functional ingredients, other than the peracid and source of acidity to lower the pH, can be delivered from more than one layer to allow, for example, for improved stability of ingredients by separation of incompatible ingredients.

DETAILED DESCRIPTION OF THE PREFERRED EMBODIMENTS

The compositions of the inventions may be in any conventional solid form useful in machine dishwashing and warewashing applications, but are preferably in the form of a tablet having at least two layers.

First Layer

The first layer of a two-layer tablet comprises from about 5 wt. % to about 90 wt. %, of a builder, preferably from about 10 wt. % to about 80 wt. %, most preferably from about 15 wt. % to about 75 wt. %; an effective amount of at least one enzyme selected from the group consisting of a protease, an amylase and mixtures thereof, and a buffering system to deliver a pH in the wash water of about 9.0 to about 11.0. Optional ingredients may also be included.

Detergent Builder Materials

The compositions of this invention can contain all manner of detergent builders commonly taught for use in machine dishwashing or other cleaning compositions. The builders can include any of the conventional inorganic and organic water-soluble builder salts, or mixtures thereof and may comprise about 5 to about 90% by weight and preferably, from about 10 to about 80% by weight of the cleaning composition.

Typical examples of phosphorus-containing inorganic builders, when present, include the water-soluble salts, especially alkali metal pyrophosphates, orthophosphates and polyphosphates. Specific examples of inorganic phosphate builders include sodium and potassium tripolyphosphates, pyrophosphates and hexametaphosphates.

Suitable examples of non-phosphorus-containing inorganic builders, when present, include water-soluble alkali metal carbonates, bicarbonates, sesquicarbonates, borates, silicates, including layered silicates such as SKS-6® ex. Hoechst, metasilicates, and crystalline and amorphous aluminosilicates. Specific examples include sodium carbonate (with or without calcite seeds), potassium carbonate, sodium and potassium bicarbonates, silicates including layered silicates and zeolites.

Organic detergent builders can also be used in the present invention. Examples of organic builders include alkali metal citrates, succinates, malonates, fatty acid sulfonates, fatty acid carboxylates, nitrilotriacetates, phytates, phosphonates, alkanehydroxyphosphonates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starches, oxidized heteropolymeric polysaccharides, polyhydroxysulfonates, polycarboxylates such as polyacrylates, polymaleates, polyacetates, polyhydroxyacrylates, polyacrylate/polymaleate and polyacrylate/ polymethacrylate copolymers, acrylate/maleate/vinyl alcohol terpolymers, aminopolycarboxylates and polyacetal carboxylates, and polyaspartates and mixtures thereof. Such carboxylates are described in U.S. Pat. Nos. 4,144,226, 4,146,495 and 4,686,062.

Alkali metal citrates, nitrilotriacetates, oxydisuccinates, polyphosphonates, acrylate/maleate copolymers and acrylate/maleate/vinyl alcohol terpolymers are especially preferred organic builders.

The foregoing detergent builders are meant to illustrate but not limit the types of builders that can be employed in the present invention.

Enzymes

Enzymes capable of facilitating the removal of soils from a substrate may also be present in an amount of up to about 10% by wt. Such enzymes include proteases (e.g., Alcalase®), Savinase® and Esperase® from Novo Industries A/S and Purafect OxP®, ex. Genencor), amylases (e.g., Termamyl® and Duramyl® from Novo Industries and Purafect OxAm®, ex. Genencor).

Buffering System

The buffering system is present in the first layer to deliver a pH of about 9.0 to about 11.0 in the wash water. Materials which may be selected for the buffering system include water-soluble alkali metal carbonates, bicarbonates, sesquicarbonates, borates, silicates, layered silicates such as SKS-6® ex Hoechst, metasilicates, phytic acid, borate and crystalline and amorphous aluminosilicates and mixtures thereof. Preferred examples include sodium and potassium carbonate, sodium and potassium bicarbonates, silicates, including layered silicates and borates.

Optional First Layer Ingredients

Optionally a surfactant may be included in the first layer including anionic, nonionic, cationic, amphoteric, zwitterionic surfactants and mixtures of these surface active agents. Such surfactants are well known in the detergent arts and are described at length at "Surface Active Agents and Detergents", Vol. 2 by Schwartz, Perry and Birch, Interscience Publishers, Inc., 1959, herein incorporated by reference.

Preferred surfactants are one or a mixture of:

Anionic surfactants

Anionic synthetic detergents can be broadly described as surface active compounds with one or more negatively charged functional groups. An important class of anionic compounds are the water-soluble salts, particularly the alkali metal salts, of organic sulfur reaction products having in their molecular structure an alkyl radical containing from about 6 to 24 carbon atoms and a radical selected from the group consisting of sulfonic and sulfuric acid ester radicals.

Primary Alkyl Sulfates $$R^1OSO_3M$$

where $R^1$ is a primary alkyl group of 8 to 18 carbon atoms and M is a solubilizing cation. The alkyl group $R^1$ may have a mixture of chain lengths. It is preferred that at least two thirds of the $R^1$ alkyl groups have a chain length of 8 to 14 carbon atoms. This will be the case if $R^1$ is coconut alkyl, for example. The solubilizing cation may be a range of cations which are in general monovalent and confer water solubility. Alkali metal, notably sodium, is especially envisaged. Other possibilities are ammonium and substituted ammonium ions, such as trialkanolammonium or trialkylammonium.

Alkyl Ether Sulfates $$R^1O(CH_2CH_2O)_nSO_3M$$

where $R^1$ is a primary alkyl group of 8 to 18 carbon atoms, n has an average value in the range from 1 to 6 and M is a solubilizing cation. The alkyl group $R^1$ may have a mixture of chain lengths. It is preferred that at least two thirds of the $R^1$ alkyl groups have a chain length of 8 to 14 carbon atoms. This will be the case if $R^1$ is coconut alkyl, for example. Preferably n has an average value of 2 to 5.

Fatty Acid Ester Sulfonates $$R^2CH(SO_3M)\ CO_2R^3$$

where $R^2$ is an alkyl group of 6 to 16 atoms, $R^3$ is an alkyl group of 1 to 4 carbon atoms and M is a solubilizing cation. The group $R^2$ may have a mixture of chain lengths. Preferably at least two thirds of these groups have 6 to 12 carbon atoms. This will be the case when the moiety $R^2CH(—)CO_2(—)$ is derived from a coconut source, for instance. It is preferred that $R^3$ is a straight chain alkyl, notably methyl or ethyl.

Alkyl Benzene Sulfonates $$R^4ArSO_3M$$

where $R^4$ is an alkyl group of 8 to 18 carbon atoms, Ar is a benzene ring ($C_6H_4$) and M is a solubilizing cation. The group $R^4$ may be a mixture of chain lengths. Straight chains of 11 to 14 carbon atoms are preferred.

Paraffin sulfonates having 8 to 22 carbon atoms, preferably 12 to 16 carbon atoms, in the alkyl moiety. These surfactants are commercially available as Hostapur SAS from Hoechst Celanese.

Olefin sulfonates having 8 to 22 carbon atoms, preferably 12 to 16 carbon atoms. U.S. Pat. No. 3,332,880 contains a description of suitable olefin sulfonates.

Organic phosphate based anionic surfactants include organic phosphate esters such as complex mono- or diester phosphates of hydroxyl-terminated alkoxide condensates, or salts thereof. Included in the organic phosphate esters are phosphate ester derivatives of polyoxyalkylated alkylaryl phosphate esters, of ethoxylated linear alcohols and ethoxylates of phenol. Also included are nonionic alkoxylates having a sodium alkylenecarboxylate moiety linked to a terminal hydroxyl group of the nonionic through an ether bond. Counterions to the salts of all the foregoing may be those of alkali metal, alkaline earth metal, ammonium, alkanolammonium and alkylammonium types.

Particularly preferred anionic surfactants are the fatty acid ester sulfonates with formula:

$$R^2CH(SO_3M)CO_2R^3$$

where the moiety $R^2CH(—)CO_2(—)$ is derived from a coconut source and $R^3$ is either methyl or ethyl; primary alkyl sulfates with the formula:

$$R^1OSO_3M$$

wherein $R^1$ is a primary alkyl group of 10 to 18 carbon atoms and M is a sodium cation; and paraffin sulfonates, preferably with 12 to 16 carbon atoms to the alkyl moiety.

Nonionic surfactants

Nonionic surfactants can be broadly defined as surface active compounds with one or more uncharged hydrophilic substituents. A major class of nonionic surfactants are those compounds produced by the condensation of alkylene oxide groups with an organic hydrophobic material which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative, but not limiting examples, of various suitable nonionic surfactant types are:

polyoxyalkene condensates of aliphatic carboxylic acids, whether linear- or branched-chain and unsaturated or saturated, especially ethoxylated and/or propoxylated aliphatic acids containing from about 8 to about 18 carbon atoms in the aliphatic chain and incorporating from about 2 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid, polyoxyalkene condensates of aliphatic alcohols, whether linear- or branched-chain and unsaturated or saturated, especially ethoxylated and/or propoxylated aliphatic alcohols containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol.

Ethoxylated fatty alcohols may be used alone or in admixture with anionic surfactants, especially the preferred surfactants above. The average chain lengths of the alkyl group $R^5$ in the general formula:

$$R^5O(CH_2CH_2O)_nH$$

is from 6 to 20 carbon atoms. Notably the group $R^5$ may have chain lengths in a range from 9 to 18 carbon atoms.

The average value of n should be at least 2. The numbers of ethylene oxide residues may be a statistical distribution around the average value. However, as is known, the distribution can be affected by the manufacturing process or altered by fractionation after ethoxylation. Particularly preferred ethoxylated fatty alcohols have a group $R^5$ which has 9 to 18 carbon atoms while n is from 2 to 8.

Also included within this category are nonionic surfactants having a formula:

$$R^6-(\underset{\underset{R^7}{|}}{CH_2CHO})_x(CH_2CH_2O)_y(\underset{\underset{R^8}{|}}{CH_2CHO})_zH$$

wherein $R^6$ is a linear alkyl hydrocarbon radical having an average of 6 to 18 carbon atoms, $R^7$ and $R^8$ are each linear alkyl hydrocarbons of about 1 to about 4 carbon atoms, x is an integer of from 1 to 6, y is an integer of from 4 to 20 and z is an integer from 4 to 25.

One preferred nonionic surfactant of the above formula is Poly-Tergent SLF-18® a registered trademark of the Olin Corporation, New Haven, Conn. having a composition of the above formula where $R^6$ is a $C_6$–$C_{10}$ linear alkyl mixture, $R^7$ and $R^8$ are methyl, x averages 3, y averages 12 and z averages 16. Another preferred nonionic surfactant is $$R^9O(\underset{\underset{CH_3}{|}}{CH_2CHO})_j(CH_2CH_2O)_k(CH_2CH(OH)R^{10})_l$$

wherein $R^9$ is a linear, aliphatic hydrocarbon radical having from about 4 to about 18 carbon atoms including mixtures thereof; and $R^{10}$ is a linear, aliphatic hydrocarbon radical having from about 2 to about 26 carbon atoms including mixtures thereof; j is an integer having a value of from 1 to about 3; k is an integer having a value from 5 to about 30; and z is an integer having a value of from 1 to about 3. Most preferred are compositons in which j is 1, k is from about 10 to about 20 and l is 1. These surfactants are described in WO 94/22800. Other preferred nonionic surfactants are linear fatty alcohol alkoxylates with a capped terminal group, as described in U.S. Pat. No. 4,340,766 to BASF. Particularly preferred is Plurafac® LF403 ex. BASF.

Another nonionic surfactant included within this category are compounds of formula:

$$R^{11}-(CH_2CH_2O)_qH$$

wherein $R^{11}$ is a $C_6$–$C_{24}$ linear or branched alkyl hydrocarbon radical and q is a number from 2 to 50; more preferably $R^{11}$ is a $C_8$–$C_{18}$ linear alkyl mixture and q is a number from 2 to 15.

polyoxyethylene or polyoxypropylene condensates of alkyl phenols, whether linear- or branched-chain and unsaturated or saturated, containing from about 6 to 12 carbon atoms and incorporating from about 2 to about 25 moles of ethylene oxide and/or propylene oxide.

polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tripalmitate, sorbital tristearate, sorbitan monooleate, and sorbitan trioleate. The polyoxyethylene chains may contain between about 4 and 30 ethylene oxide units, preferably about 10 to 20. The sorbitan ester derivatives contain 1,2 or 3 polyoxyethylene chains dependent upon whether they are mono-, di- or tri-acid esters.

polyoxyethylene-polyoxypropylene block copolymers having formula:

$$HO(CH_2CH_2O)_a(CH(CH_3)CH_2O)_b(CH_2CH_2O)_cH$$

or $$HO(CH(CH_3)CH_2O)_d(CH_2CH_2O)_e(CH(CH_3)CH_2O)_fH$$

wherein a, b, c, d, e and f are integers from 1 to 350 reflecting the respective polyethylene oxide and polypropylene oxide blocks of said polymer. The polyoxyethylene component of the block polymer constitutes at least about 10% of the block polymer. The material preferably has a molecular weight of between about 1,000 and 15,000, more preferably from about 1,500 to about 6,000. These materials are well-known in the art. They are available under the trademark "Pluronic®" and "Pluronic R®", a product of BASF Corporation.

Amine oxides having formula:

$$R^{12}R^{13}R^{14}N{=}O$$

wherein $R^{12}$, $R^{13}$ and $R^{14}$ are saturated aliphatic radicals or substituted saturated aliphatic radicals. Preferable amine oxides are those wherein $R^{12}$ is an alkyl chain of about 10 to about 20 carbon atoms and $R^{13}$ and $R^{14}$ are methyl or ethyl groups or both $R^{12}$ and $R^{13}$ are alkyl chains of about 6 to about 14 carbon atoms and $R^{14}$ is a methyl or ethyl group.

Amphoteric synthetic detergents can be broadly described as derivatives of aliphatic tertiary amines, in which the aliphatic radical may be straight chain or branched and wherein one of the aliphatic substituents contain from about 8 to about 18 carbons and one contains an anionic water-solubilizing group, i.e., carboxy, sulpho, sulphato, phosphato or phosphono. Examples of compounds falling within this definition are sodium 3-dodecylamino propionate and sodium 2-dodecylamino propane sulfonate.

Zwitterionic synthetic detergents can be broadly described as derivatives of aliphatic quaternary ammonium, phosphonium and sulphonium compounds in which the aliphatic radical may be straight chained or branched, and wherein one of the aliphatic substituents contains from about 8 to about 18 carbon atoms and one contains an anionic water-solubilizing group, e.g., carboxy, sulpho, sulphato, phosphato or phosphono. These compounds are frequently referred to as betaines. Besides alkyl betaines, alkyl amino and alkyl amido betaines are encompassed within this invention.

Alkyl Glycosides $$R^{15}O(R^{16}O)_n(Z^1)_p$$

wherein $R^{15}$ is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; $R^{16}$ is a divalent hydrocarbon radical containing from 2 to about 4 carbon atoms such as ethylene, propylene or butylene (most preferably the unit $(R^{16}O)_n$ represents repeating units of ethylene oxide, propylene oxide and/or random or block combinations thereof); n is a number having an average value of from 0 to about 12; $Z^1$ represents a moiety derived from a reducing saccharide containing 5 or 6 carbon atoms (most preferably a glucose unit); and p is a number having an average value of from 0.5 to about 10 preferably from about 0.5 to about 5.

Examples of commercially available materials from Henkel Kommanditgesellschaft Aktien of Dusseldorf, Germany include APG® 300, 325 and 350 with $R^{15}$ being $C_9$–$C_{11}$, n is 0 and p is 1.3, 1.6 and 1.8–2.2 respectively; APG® 500 and 550 with $R^{15}$ is $C_{12}$–$C_{13}$, n is 0 and p is 1.3 and 1.8–2.2, respectively; and APG® 600 with $R^{15}$ being $C_{12}$–$C_{14}$, n is 0 and p is 1.3.

While esters of glucose are contemplated especially, it is envisaged that corresponding materials based on other reducing sugars, such as galactose and mannose are also suitable.

Particularly preferred nonionic surfactants are polyoxyethylene and polyoxypropylene condensates of linear aliphatic alcohols.

The preferred range of surfactant is from about 0.5 to 30% by wt., more preferably from about 0.5 to 15% by wt of the composition.

Sequestrants

The detergent compositions herein may also optionally contain one or more transition metal chelating agents. Such chelating agents can be selected from the group consisting of amino carboxylates, amino phosphonates, polyfunctionally-substituted aromatic chelating agents and mixtures therein. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetraacetates, N-hydroxyethylethylenediaminetriacetates, nitrilotriacetates, ethylenediamine tetraproprionates, triethylenetetraaminehexaacetates, diethylenetriaminepentaacetates, ethylenediamine disuccinate, and ethanoldiglycines, alkali metal, ammonium, and substituted ammonium salts therein and mixtures therein.

Amino phosphonates are also suitable for use as chelating agents in the compositions of the invention when at least low levels of total phosphorus are permitted in detergent compositions, and include ethylenediaminetetrakis (methylenephosphonates), nitrilotris (methylenephosphonates) and diethylenetriaminepentakis (methylenephosphonates). Preferably, these amino phosphonates do not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

If utilized, these chelating agents will generally comprise from about 0.1% to about 10% by weight of the detergent compositions herein. More preferably, if utilized, the chelating agents will comprise from about 0.1% to about 5% by weight of such composition.

Anti-Scalants

Scale formation on dishes and machine parts can be a significant problem. It can arise from a number of sources but, primarily it results from precipitation of either alkali earth metal carbonate, phosphates and silicates. Calcium carbonate and phosphates are the most significant problem. To reduce this problem, ingredients to minimize scale formation can be incorporated into the composition. These include polyacrylates of molecular weight from 1,000 to 400,000 examples of which are supplied by Rohm & Haas, BASF and Alco Corp. and polymers based on acrylic acid combined with other moieties. These include acrylic acid combined with maleic acid, such as Sokalan® CP5 supplied by BASF or Acusol® 479N supplied by Rohm & Haas; with vinyl pyrrolidone such as Acrylidone® supplied by ISP; with methacrylic acid such as Colloid 226/35® supplied by Rhone-Poulenc; with phosphonate such as Casi 773® supplied by Buckman Laboratories; with maleic acid and vinyl acetate such as polymers supplied by Huls; with acrylamide; with sulfophenyl methallyl ether such as Aquatreat® AR 540 supplied by Alco; with 2-acrylamido-2-methylpropane sulfonic acid such as Acumer® 3100 supplied by Rohm & Haas; with sulfonic acid such as K-775 supplied by Goodrich; with sulfonic acid and sodium styrene sulfonatesuch as K-798 supplied by Goodrich; with methyl methacrylic acid, sodium methallyl sulfonate and sulfophenyl methallyl ether such as Alcoperse® 240 supplied by Alco; polymaleates such as Belclene® 200 supplied by FMC; polymethacrylates such as Tamol® 850 from Rohm & Haas; polyaspartates; ethylenediamine disuccinate; organo polyphosphonic acids and their salts such as the sodium salts of aminotri(methylenephosphonic acid) and ethane 1 -hydroxy-1,1 -diphosphonic acid. The anti-scalant, if present, is included in the composition from about 0.05% to about 10% by weight, preferably from 0.1% to about 5% by weight, most preferably from about 0.2% to about 5% by weight.

Tablet Additives

Tablets frequently require adjuncts, called excipients. These have many uses, for example, in binding the ingredients together in the tablet, in aiding disintegration of the tablet in the wash and to facilitate manufacture of the tablet. The key ingredients in this category are binders, disintegrants and lubricants. One important property of these tablet additives is that they be compatible with the active ingredients in the tablet. Often, a binder also performs the role of disintegrant and it is useful to consider these two functions together.

The purpose of the binder/disintegrant is to help hold the ingredients of the tablet together but still allow dissolution in the wash water. With certain ingredients, a binder is essential to allow formation of a tablet but, even when a tablet can be formed in the absence of the binder, incorporation of a binder allows use of lower compaction pressures which aids in the breakdown of the tablet in the wash liquor. Lower compaction pressures allow for higher throughput during processing of tablets while decreasing the probability of mechanical breakdown of parts due to high stress.

A number of binders and disintegrants are described in "Pharmaceutical Dosage Forms: Volume 1", 1989, Marcel Dekker Inc., ISBN 0-8247-8044-2, herein incorporated by reference. Both natural polymeric materials and synthetic polymers are useful. These include starches, such as corn, maize, rice and potato starches and starch derivatives such as U-Sperse M® and U-Sperse® supplied by National Starch, Primojel® carboxymethyl starch and sodium starch glycolate such as Explotab®, pregelatinized corn starches such as National® 1551 and Starch® 1500; celluloses and cellulose derivatives including sodium carboxymethyl cellulose such as Courlose® and Nymcel®, cross-linked sodium carboxymethyl cellulose such as Ac-Di-Sol® supplied by FMC Corp., microcrystalline cellulosic fibers such as Hanfloc®, microcrystalline cellulose such as Lattice® NT supplied by FMC Corp. and Avicel® PH supplied by FMC Corp. methylcellulose, ethylcellulose, hydroxypropylcellulose and hydroxypropylmethylcellulose. Other polymers useful as binders/disintegrants are polyvinylpyrrolidones such as Plasdone®, PVP® K-30 and PVP® K-60 all supplied by International Specialty Products; polyvinylpolypyrrolidones, a cross-linked homopolymer of N-vinyl-2-pyrrolidone such as Polyplasdone® XL supplied by International Specialty Products; polymethacrylates, polyvinyl alcohols and polyethylene glycols. Gums such as acacia, tragacanth, guar, locust bean and pectin, gelatin, sucrose and alginates are also useful as binders/disintegrants. Suitable inorganic materials include magnesium aluminum silicate such as Veegum® HV supplied by R. T. Vanderbilt Co. Inc., bentonite and montmorillonite such as Gelwhite® supplied by Southern Clay Products. Other suitable binders include monoglycerides such as lmwitor® 191 supplied by Huls America Inc., glyceryl stearates such as lmwitor® 900 supplied by Huls America Inc., and palm oil glycerides such as Inwitor (R) 940 supplied by Huls America Inc. Most preferred as binders/disintegrates are microcrystalline celluloses and polyethylene glycols. Preferred polyethylene glycols have molecular weights from about 2,000 to about 15,000.

Another way of enhancing dissolution of a tablet in the wash water is to incorporate an effervescent system. This includes weak acids or acid salts such as citric acid, maleic acid, tartaric acid, sodium hydrogen phosphates, in combination with a basic ingredient that evolves carbon dioxide when interacting with this acid source. Examples include sodium and potassium carbonate and bicarbonate and sodium sesquicarbonate.

Other tablet additives commonly used are lubricants to aid the tabletting process, such as stearates, waxes, hydrogenated vegetable oils and polyethylene glycols and fillers such as sugars, sodium sulfate and sodium chloride.

Minor amounts of various other components may be present in the first layer of the tablet. These components include bleach scavengers including but not limited to sodium bisulfite, sodium perborate, reducing sugars, and short chain alcohols; enzyme stabilizing agents; soil suspending agents; antiredeposition agents; anti-corrosion agents, such as benzotriazole and its derivatives, isocyanuric acid described in Angevaare, U.S. Pat. No. 5,374,369; purine derivatives described in Angevaare, U.S. Pat. No. 5,468,410; 1,3-N azole compounds described in Gary, U.S. Pat. No. 5,480,576; ingredients to enhance decor care such as certain aluminum salts described in U.S. Ser. Nos. 08/444,502 and 08/444,503, colorants; perfumes; defoamers such as mono- and distearyl phosphate silicone oil, mineral oil and those described in Angevaare et al., U.S. Ser. No. 08/539,923 and other functional additives. All publications herein incorporated by reference.

Optionally the functional ingredients described above included in the first layer of a two layer tablet may also be delivered from multiple layers to enhance performance by controlling the release of the ingredients or to improve storage stability of mutually incompatible ingredients.

Second Layer

A second tablet layer of a two layer tablet comprises a continuous medium that has a minimum melting point at about 35° C. and a maximum melting point of about 50° C. and a solids content of 0% to about 10% at 60° C. and acts as a carrier for a peracid and a source of acidity releasing these ingredients at the appropriate time during the wash cycle.

Materials of the Continuous Medium

Materials suitable for use as the continuous medium of the last layer of the tablet must have a number of characteristics. Thus, the material must be chemically compatible with ingredients to be incorporated into the layer, must be compressible into a tablet layer and must have a suitable release profile, especially an appropriate melting point range. The preferred melting point range is from about 35° C. to about 50° C. the materials having a solids content of 0% to about 10% at 60° C. Paraffin waxes, microcrystalline waxes and natural waxes give good results. Some preferred paraffin waxes, all of which have 0% solids content at 60° C., include Merck 7150® and Merck 7151® supplied by E. Merck of Darmstadt, Germany; Boler® 1398, Boler® 1538 and Boler® 1092 supplied by Boler of Wayne, Pa.; Ross® fully refined paraffin wax 115/120 supplied by Frank D. Ross Co., Inc of Jersey City, N.J.; Tholler® 1397 and Tholler® 1538 supplied by Tholler of Wayne, Pa.; Paramelt® 4608 supplied by Terhell Paraffin of Hamburg, Germany and Paraffin® R7214 supplied by Moore & Munger of Shelton, Conn.

Natural waxes, such as natural bayberry wax, m.pt. 42°–48° C. supplied by Frank D. Ross Co., Inc, are also useful as are synthetic substitutes of natural waxes such as synthetic spermaceti wax, m.pt. 42–50, supplied by Frank D. Ross Co., Inc., synthetic beeswax (BD4) and glyceryl behenate (HRC) synthetic wax.

Polyvinyl ether is useful as a material of the continuous medium. The molecular formula is [CxH2xO]y wherein x is 18–22 and y is 150–300, preferably x is 18–22 and y is 150–280, most preferably x is 20 and y is 150–250. The melting point range is from about 40° C. to about 50° C. A preferred polyvinyl ether material is supplied by BASF under the Luwax® V series. Polyvinyl ether is especially useful when mixed with a wax of a suitable melting point range.

Other options for the material of the continous medium are fatty acids such as lauric acid and fatty acid derivatives such as the alkonamides and glyceryl esters, mono-, di- and triglycerides, alkali metal salts of fatty acids and fatty alkyl phosphate esters. Lime soap dispersants and antifoaming agents may be required if fatty acids or their derivatives are used for the continuous medium. Mixtures of fatty acids that have the appropriate melting point range are also acceptable. Polyethylene waxes of suitable melting point are also useful, especially when mixed with suitable waxes.

Other potential materials for use as the continuous medium are solid surfactants, especially nonionic surfactants. Incorporation of an anti-foaming agent is likely to be required with use of surfactant. Surfactants useful in this invention are listed under "Surfactants" above. Examples are polyoxyalkene condensates of aliphatic acids, alcohols and phenols, polyoxyalkalene block copolymers and block copolymers derived from addition of propylene oxide and ethylene oxide to ethylenediamine. Other suitable materials are sorbitan esters, polyoxyethylene sorbitan fatty acid esters, polyethylene glycols, polyvinyl alcohols, ethylene-vinylacetate, styrene-vinylacetate and ethylene-maleic anhydride copolymers and partially esterified polymers of maleic anhydride, acrylic acid or methacrylic acid.

Most preferred are paraffin waxes either alone or as a mixture with polyvinyl ethers.

Source of Acidity

The amount of acidity agent present in the second layer is dependent on the amount and the source of the buffering system in the first layer. The amount of acidity incorporated should be such that the pH of the wash water after release of the acidity should be below about pH 9, preferably below about pH 8.5 and most preferably below about pH 8. The acidity agent is thus present in an amount of up to 50 wt. %, 1 to preferably 40 wt. %. The source of acidity can be added directly, as is, to the continuous medium of the second layer or be granulated with a binder and optionally with a surfactant for rapid dissolution prior to mixing with the continuous medium. The acidity granules should be between 100 and 2,000 microns and size. An alternative method of incorporating the acidity source is to coat the acidity granule with the continuous medium of the second layer in, for instance, a fluid bed, pan coater or rolling drum to produce encapsulates which may be directly used to form the second layer. Particularly preferred methods of producing the encapsulates optionally with a surfactant for the rapid dissolution are described in Nicholson, U.S. Pat. No. 5,480,577 herein incorporated by reference.

A range of acidity sources are suitable for the invention. It is preferable that the source of acidity be solid at room temperature. Mono-, di- and polycarboxylates are especially useful sources of acidity including lactic acid, glycolic acid, adipic acid, fumaric acid, maleic acid, malic acid, succinic acid, tartaric acid, malonic acid, tartronic acid, glutaric acid, gluconic acid, ascorbic acid, citric acid. Preferred inorganic sources of acidity include boric acid and the alkali metal and alkali earth metal salts of bicarbonate, hydrogen sulfate and hydrogen phosphate. Organo phosphoric acids, such as 1-hydroxyethane 1,1-diphosphoric acid or amino polymethylene phosphoric acid are also useful. Most preferred is citric acid.

Peroxy Bleaching Agents

The oxygen bleaching agents of the compositions include organic peroxy acids and diacylperoxides. Typical monoperoxy acids useful herein include alkyl peroxy acids and aryl peroxy acids such as:

i) peroxybenzoic acid and ring-substituted peroxybenzoic acids, e.g., peroxyalpha-naphthoic acid, and magnesium monoperoxyphthalate, ii) aliphatic and substituted aliphatic monoperoxy acids, e.g., peroxylauric acid, peroxystearic acid, epsilon-phthalimido-peroxyhexanoic acid and o-carboxybenzamido peroxyhexanoic acid, N-nonylamidoperadipic acid and N-nonylamidopersuccinic acid, iii) Cationic peroxyacids such as those described in U.S. Pat. Nos. 5,422,028, 5,294,362; and 5,292,447 U.S. Ser. No. 08/738,504 filed Oct. 24, 1996, now allowed, and U.S. Ser. No. 08/210,973, Oakes et al., herein incorporated by reference, iv) Sulfonyl peroxyacids such as compounds described in U.S. Pat. No. 5,039,447 (Monsanto Co.), herein incorporated by reference.

Typical diperoxy acids useful herein include alkyl diperoxy acids and aryl diperoxy acids, such as:

v) 1,12-diperoxydodecanedioic acid vi) 1,9-diperoxyazelaic acid vii) diperoxybrassylic acid; diperoxysecacic acid and diperoxy-isophthalic acid viii) 2-decyldiperoxybutan-1,4-dioic acid ix) N,$N^1$-terephthaloyl-di(6-aminopercaproic acid).

A typical diacylperoxide useful herein includes dibenzoylperoxide.

Inorganic peroxygen compounds are also suitable for the present invention. Examples of these materials useful in the invention are salts of monopersulfate, perborate monohydrate, perborate tetrahydrate, and percarbonate.

Preferred oxygen bleaching agents include epsilon-phthalimido-peroxyhexanoic acid, o-carboxybenzamidoperoxyhexanoic acid, and mixtures thereof.

The organic peroxy acid is present in the compositon in an amount such that the level of organic peroxy acid delivered to the wash solution is about 1 ppm to about 100 ppm available oxygen (AvOx), preferably about 2 ppm to about 50 ppm AvOx, most preferably about 2 ppm to about 20 ppm AvOx.

The oxygen bleaching agent may be added directly to the continuous medium or may be encapsulated with material of the continuous medium by any number of encapsulation techniques prior to compaction.

A preferred encapsulation method is described in U.S. Pat. No. 5,200,236 issued to Lang et al., herein incorporated by reference. In the patented method, the bleaching agent is encapsulated as a core in a paraffin wax material having a melting point from about 40° C. to 50° C. The wax coating has a thickness of from 100 to 1500 microns.

It is preferred that the peracid be added directly into the continuous medium rather than be encapsulated with material of the continuous medium.

While not critical, for optimum performance of tablets of this invention it is preferable that, during the wash process, a minimum of about 25% of the first layer of a two-layer tablet or a minimum of about 25% of the contents of all but the last layer of a multi-layer tablet should dissolve during the period of the wash process prior to the wash temperature reaching 50° C. Additionally, of the contents of the second layer of a two-layer tablet or the last layer of a multi-layer tablet, a maximum of about 50% should dissolve or disperse during the wash process prior to the temperature reaching 45° C., and preferably about 100% should dissolve or disperse prior to the end of the main wash, assuming the water temperature of the main wash reaches a minimum of 50° C.

Inclusion of surfactant into the second layer is desirable to ensure good dispersion of the continuous medium of the second layer into the wash water. Preferred surfactants are nonionics produced by the condensation of alkylene oxide groups with an organic hydrophobic material which may be aliphatic or alkyl aromatic in nature. Especially preferrred surfactants are described in WO 94/22800 of which those that have a melting point above 20° C. are most preferred.

Processing of Tablets

For a two-layer tablet, the ingredients of the first layer are admixed, transferred to the tablet die and compressed with a compaction pressure from about $5\times10^6$ kg/m$^2$ to about $3\times10^7$ kg/m$^2$. Processing of the second layer can proceed via a number of routes.

The materials for the continuous medium of the second layer are frequently most conveniently available in a solid form and thus are preferably handled by mixing flakes with the acidic moiety and the peracid. This whole mixture is then transferred to the die on top of the first layer and compressed with a compaction pressure from about $1\times10^6$ kg/m$^2$ to about $3\times10^7$ kglm$^2$. A preferred route is to pre-granulate the peracid with a surfactant and an exotherm agent to give granulates having an average diameter of about 100–2000 microns and mix these together with both the acidity moiety and the material of the continuous medium prior to compaction. It is also preferred that the acidity moiety be pre-granulated prior to tabletting either by itself or in combination with the peracid. Another way of creating the second layer is to pre-coat the peracid granules with the continuous medium via, for example, a fluid bed, pan coater or a rolling drum to give encapsulates and optionally to follow the same procedure for the acid granulates. Again, the acidity source can be co-granulated with the peracid prior to coating with the continuous medium. The encapsulates are compressed with a compaction pressure from about $1\times10^6$ kg/m$^2$ to about $3\times10^7$ kg/m$^2$ to give a second layer with discrete capsules of peracid, acidity moiety or a mixture of peracid and acidity ingredients.

It is often advisable to also add surfactant separately into the second layer to ensure good dispersion of the material of the continuous medium of the second layer into the wash water. This is best achieved by pre-mixing a surfactant that is solid at room temperature with the materials at the continuous medium of the layer prior to compaction.

The same process is utilized for multi-layer tablets except that the ingredients of all but the last layer are sequentially compacted within their respective layers.

The following examples will serve to distinguish this invention from the prior art and illustrate the inventive embodiments more fully. Unless otherwise indicated, all parts, percentages and proportions referred to are by weights.

EXAMPLE 1

Single layer tablets, outside the scope of this invention, were prepared with compositions shown in Table 1. All values are in grams of ingredient and, unless specified, all anionic species are the sodium salts. The ingredients were compacted at a pressure of $8\times10^6$ kg/m$^2$ to give a tablet of 34 mm diameter and 14 mm thickness.

TABLE 1

| Component | A | B |
|---|---|---|
| Tripolyphosphate | 13 | 13 |
| Disilicate | 6 | 3 |
| Polyethylene Glycol, M. Wt 4,600 | 3 | 3 |
| Amylase[1] | 0.75 | 0.75 |
| Protease[2] | 0.35 | 0.35 |
| PAP[3] | 0.92 | 0.92 |

[1]Duramyl ® ex Novo
[2]Purafect OxP ® ex Genecor
[3]Phthalimidoperhexanoic Acid The tablets were evaluated in the Rapid Cycle of a Bauknecht® GSF 3174S dishwashing machine. The tablets were introduced into the machine via a basket hanging from the top rack. Egg-soiled plates, wheat-soiled plates and cups stained three times with tea were used as monitors. Performance was evaluated by visual assessment of the articles after washing. Plates were scored on 0% (no residual soil) to 100% (whole plate covered with layer of soil) scale. A numeric scale from 0 (no residual stain) to 5 (heavy stain) was used to evaluate the cups.

The results are shown in Table 2. In this table, pH' refers to the wash pH five minutes into the cycle and pH" refers to the wash pH ten minutes into the cycle.

TABLE 2

| Tablet | pH' | pH" | Egg | Wheat | Tea |
|---|---|---|---|---|---|
| A | 9.7 | 9.9 | 5 | 25 | 2.0 |
| B | 8.0 | 8.0 | 75 | 25 | 0.0 |

Tablet A and B are based on conventional technology. Tablet A is buffered at a high pH where proteases are effective in removing protein soil such as egg but where peracid bleach is not especially effective since this pH is not close to the pKa of the peracid. These conclusions are borne out by the results for Tablet A where egg soil removal is good and bleaching is poor. Tablet B is buffered at a low pH and the reverse is true here with good bleaching and poor protein soil removal. Thus, with peracid as the bleach source, current technology is unable to deliver both good bleaching and good protein soil removal from a tablet.

EXAMPLE 2

Two-layer tablets were prepared with the compositions shown in Tables 3 and 4. All values are in grams of ingredient and, unless specified, all anionic species are the sodium salts. The tablets were processed according to the specifications above with the PAP pre-granulated with citric acid, which acted as both an exotherm control agent and a source of acidity, and mixed with flakes of a paraffin wax prior to tabletting. The ingredients of Layer 1 were compacted at a pressure of $8\times10^6$ kg/m$^2$ and the ingredients of Layer 2 were compacted at a pressure of $5\times10^6$ kg/m$^2$ to give a tablet of 34 mm diameter and 18 mm thickness. Two sets of tablets were processed, with two different levels of protease. Tablets C, D and E contain a medium level of protease whereas Tablets F, G and H contain a high level of protease.

Tablets C, D, F and G lie outside the scope of this invention, whereas Tablets E and H lie within its scope.

TABLE 3

| | Tablet | | | | | |
|---|---|---|---|---|---|---|
| | Component | | | | | |
| | C | | D | | E | |
| | Layer 1 | Layer 2 | Layer 1 | Layer 2 | Layer 1 | Layer 2 |
| Tripolyphosphate | 13.0 | | 13.0 | | 13.0 | |
| Disilicate | 6.0 | | 3.0 | | 4.0 | |
| Carbonate | 0.0 | | 0.0 | | 2.0 | |
| PEG[1] | 3.0 | | 3.0 | | 3.0 | |
| Amylase[2] | 0.35 | | 0.35 | | 0.35 | |
| Protease[3] | 0.75 | | 0.75 | | 0.75 | |
| PAP[4] | | 0.9 | | 0.9 | | 0.9 |
| Citric Acid | | 0.0 | | 0.0 | | 2.0 |
| Wax[5] | | 1.0 | | 1.0 | | 1.0 |

[1]Polyethylene Glycol, molecular weight 4,600
[2]Duramyl ® ex Novo
[3]Purafect OxP ® ex Genencor
[4]Phthalimidoperhexanoic Acid
[5]Boler ® 1397, M. pt. 42–46 C.

TABLE 4

| | Tablet | | | | | |
|---|---|---|---|---|---|---|
| | Component | | | | | |
| | F | | | | | |
| | Layer 1 | Layer 2 | G Layer 1 | G Layer 2 | H Layer 1 | H Layer 2 |
| Tripolyphosphate | 13.0 | | 13.0 | | 13.0 | |
| Disilicate | 6.0 | | 3.0 | | 4.0 | |
| Carbonate | 0.0 | | 0.0 | | 2.0 | |
| PEG[1] | 3.0 | | 3.0 | | 3.0 | |
| Amylase[2] | 0.35 | | 0.35 | | 0.35 | |
| Protease[3] | 1.15 | | 1.15 | | 1.15 | |
| PAP[4] | | 0.9 | | 0.9 | | 0.9 |
| Citric Acid | | 0.0 | | 0.0 | | 2.0 |
| Wax[5] | | 1.0 | | 1.0 | | 1.0 |

The tablets were evaluated in the Rapid Cycle of a Bauknecht ® GSF 3174S dishwashing machine. The tablets were introduced into the machine via a basket

[1]Polyethylene Glycol, molecular weight 4,600

[2]Duramyl ® ex Novo

[3]OxP ® ex Genencor

[4]Phthalimidoperhexanoic Acid

[5]Boler ® 1397, M. pt. 42–46 C.

hanging from the top rack. Egg-soiled plates, wheat-soiled plates and cups stained three times with tea were used as monitors. Performance was evaluated by visual assessment of the articles after washing. Plates were scored on 0% (no residual soil) to 100% (whole plate covered with layer of soil) scale. A numeric scale from 0 (no residual stain) to 5 (heavy stain) was used to evaluate the cups.

The results are shown in Table 5. In this table, pH' refers to the wash pH five minutes into the cycle and pH" refers to the wash pH ten minutes into the cycle.

TABLE 5

| Tablet | pH' | pH" | Egg | Wheat | Tea |
|---|---|---|---|---|---|
| C | 9.9 | 9.8 | 20 | 10 | 3.5 |
| D | 8.0 | 8.3 | 65 | 10 | 0.8 |
| E | 9.3 | 8.5 | 10 | 5 | 0.5 |
| F | 9.8 | 9.6 | 10 | 20 | 3.0 |
| G | 8.S | 7.4 | 55 | 5 | 0.3 |
| H | 9.4 | 8.6 | 10 | 15 | 0.0 |

The advantage of the technology of the current invention is clear. In Tablets C and F, which are outside the scope of this invention, there is delayed release of peracid. However, because there is not concurrent delayed release of an acidity source, a high pH is maintained throughout the wash which does not allow the peracid to function optimally. Thus, for Tablets C and F, protein soil removal is good but tea stain removal is poor.

Tablets D and G are also outside the scope of this invention. Both of these tablets incorporate the controlled peracid release technology, but a low wash pH is maintained throughout the cycle. Thus, in both cases, tea stain removal is good, but protein soil removal is poor.

Tablets E and H lie within the scope of the invention and in each case a buffer maintains a high pH during the initial part of the wash which is followed by controlled release of both a peracid and a source of acidity that results in a drop in wash pH. As a result, only Tablets E and H can deliver both good protein soil and tea stain removal.

We claim:

1. A detergent composition in solid form useful for machine dishwashing comprising a) a first layer comprising (i) a buffering system, (ii) about 5 wt. % to about 90 wt. % of a builder, (iii) an effective amount up to 10 wt. % of an enzyme used to facilitate the removal of soils, wherein the first layer dissolves to deliver a pH of about 9.0 to about 11 in wash water; and b) a second layer comprising (i) an effective amount of a peracid to bleach the soils in a machine dishwasher, (ii) 1–40 wt. % of an acidity agent, and (iii) an effective amount of a material to form a continuous medium as a carrier for the peracid and acidity agent, the material having a melting point in the range of from about 35° to about 50°, wherein the second layer dissolves in the wash water to deliver a pH of from about 6.5 to about 9.

2. The detergent composition according to claim 1 wherein the peracid is selected from the group consisting of organic peroxy acid, diacyl peroxides and mixtures thereof.

3. The detergent composition according to claim 2 wherein the organic peroxy acid is selected from the group consisting of peroxy benzoic acid, ring substituted peroxy benzoic acid, aliphatic monoperoxy acid, substituted aliphatic monoperoxy acid and mixtures thereof.

4. The detergent composition according to claim 3 wherein the aliphatic monoperoxy acid is phthalimidoperoxyhexanoic acid, o-carboxybenzamido peroxy hexanoic acid and mixtures thereof.

5. The detergent composition according to claim 1 wherein the acidity agent is selected from the group consisting of monocarboxylates, dicarboxylates, polycarboxylates, boric acid, alkali metal salts of bicarbonates, alkali earth metal salts of bicarbonate, hydrogen sulfate, hydrogen phosphate, organic phosphoric acids and mixtures thereof.

6. The detergent composition according to claim 1 wherein the material of the continuous medium is selected from the group consisting of a paraffin wax, a natural wax, a polyvinyl ether, fatty acids and mixtures thereof.

7. The detergent composition according to claim 6 wherein the paraffin wax and the natural wax have a solids content of 0 to about 10% at 60° C.

8. The detergent composition according to claim 1 wherein the polyvinyl ether material is present in an amount of from about 70 to about 1 wt. % and has a formula:

$$(C_xH_{2x}O)_y$$

wherein x is an integer from 18 to 22 and y is an integer from 150 to 300.

9. The detergent composition according to claim 1 wherein the buffering system is selected from the group consisting of water soluble alkali metal carbonate, bicarbonate, sequicarbonate, borate, silicate, layered silicate, amorphous aluminum silicate and mixtures thereof.

10. The detergent composition according to claim 1 wherein the enzyme is selected from the group consisting of a protease, an amylase and mixtures thereof.

11. The detergent composition according to claim 1 wherein the first layer further comprises from about 0.1 to about 30% by wt. of a surfactant.

12. The detergent composition according to claim 1 wherein the solid form of the composition is a tablet.

13. The detergent composition according to claim 12 wherein the tablet has more than two layers.

14. A method for cleaning tableware in a machine dishwasher comprising the steps of a) dissolving a detergent composition in solid form in wash water, the composition having a first layer comprising
   (i) a buffering system
   (ii) about 5 wt. % to about 90 wt. % of a builder,
   (iii) an effective amount up to 10 wt. % of an enzyme used to facilitate the removal of soil, wherein the first layer dissolves to deliver a pH of about 9.0 to about 11 in the wash water; and (b) a second layer comprising
   (i) an effective amount of peracid to bleach the soils in the machine dishwasher,
   (ii) 1–40wt. % of an acidity agent, and
   (iii) an effective amount of a material to form a continuous medium as a carrier for the peracid and acidity agent, the material having a melting point in the range of from 35° C. to about 50° C., wherein the second layer dissolves in the wash water to deliver a pH of from about 6.5 to about 9; and c) supplying the composition to the tableware to substantially clean it.

15. The method according to claim 14 wherein the peracid is selected from the group consisting of organic peroxy acid, diacyl peroxides and mixtures thereof.

16. The method according to claim 14 wherein the organic peroxy acid is selected from the group consisting of peroxy benzoic acid, ring substituted peroxy benzoic acid, aliphatic monoperoxy acid, substituted aliphatic monoperoxy acid and mixtures thereof.

17. The method according to claim 16 wherein the aliphatic monoperoxy acid is phthalimidoperoxyhexanoic acid, o-carboxybenzamido peroxy hexanoic acid and mixtures thereof.

18. The method according to claim 14 wherein the material of the continuous medium is selected from the group consisting of a paraffin wax, a natural wax, a polyvinyl ether, fatty acids and mixtures thereof.

19. The method according to claim 14 wherein the solid form of the composition is a tablet.

* * * * *